United States Patent [19]

Estruch

[11] 4,414,691

[45] Nov. 15, 1983

[54] REVERSIBLE BATHING GARMENT

[75] Inventor: Jose Estruch, San Juan, P.R.

[73] Assignee: Fabrilmalla, Inc., Guaynabo, P.R.

[21] Appl. No.: 384,479

[22] Filed: Jun. 3, 1982

[51] Int. Cl.[3] ..... A41D 5/00; A41B 9/00

[52] U.S. Cl. ..... 2/67; 2/DIG. 7; 2/400

[58] Field of Search ..... 2/67, 400, DIG. 2, 406

[56] References Cited

U.S. PATENT DOCUMENTS 2,873,738 2/1959 Stark ..... 2/67

3,939,845 2/1976 Guidoni ..... 2/67

*Primary Examiner*—Doris L. Troutman

*Attorney, Agent, or Firm*—Kane, Dalsimer, Kane, Sullivan & Kurucz

[57] ABSTRACT

Reversible, textile bathing garments are described.

3 Claims, 2 Drawing Figures

REVERSIBLE BATHING GARMENT

BACKGROUND OF THE INVENTION

1. Field of the Invention

The invention relates to outerwear suitable for use while swimming or bathing and more particularly relates to such garments which are reversible.

2. Brief Description of the Prior Art

One and two piece swimming garments for use as outerwear by females are well-known. Heretofore such garments were characterized in part by having two distinct surfaces, i.e.; an inner side or lining and an outer side. The inner and outer sides were of a distinctly different character, each suitable for their purpose. In other words, the inner side was a lining for providing comfort to the wearer of the garment while the outer side may have been more wear resistant (durable) or more decorative in character.

The bathing garments of the present invention have neither an exclusive inner nor an outer side and each side can function as one or the other, i.e.; it is a reversible garment, each side of which may be worn as the outer side or the inner side.

SUMMARY OF THE INVENTION

The invention comprises a reversible, bathing garment, which comprises:

a single, unseamed cloth having a first planar surface and a second planar surface, said surfaces being mutually bounded by a peripheral edge;

said cloth having been cut to a size and configuration whereby it will, when worn by said person, cover private parts of said person;

a binding tape secured to and covering the entirety of the peripheral edge and tape being symmetrically secured so that is provides similar binding to each planar surface peripheral edge; and means co-extensive with the binding tape for supporting the cloth on the body of said person.

DETAILED DESCRIPTION OF THE PREFERRED EMBODIMENTS OF THE INVENTION

Figures 1, 2:
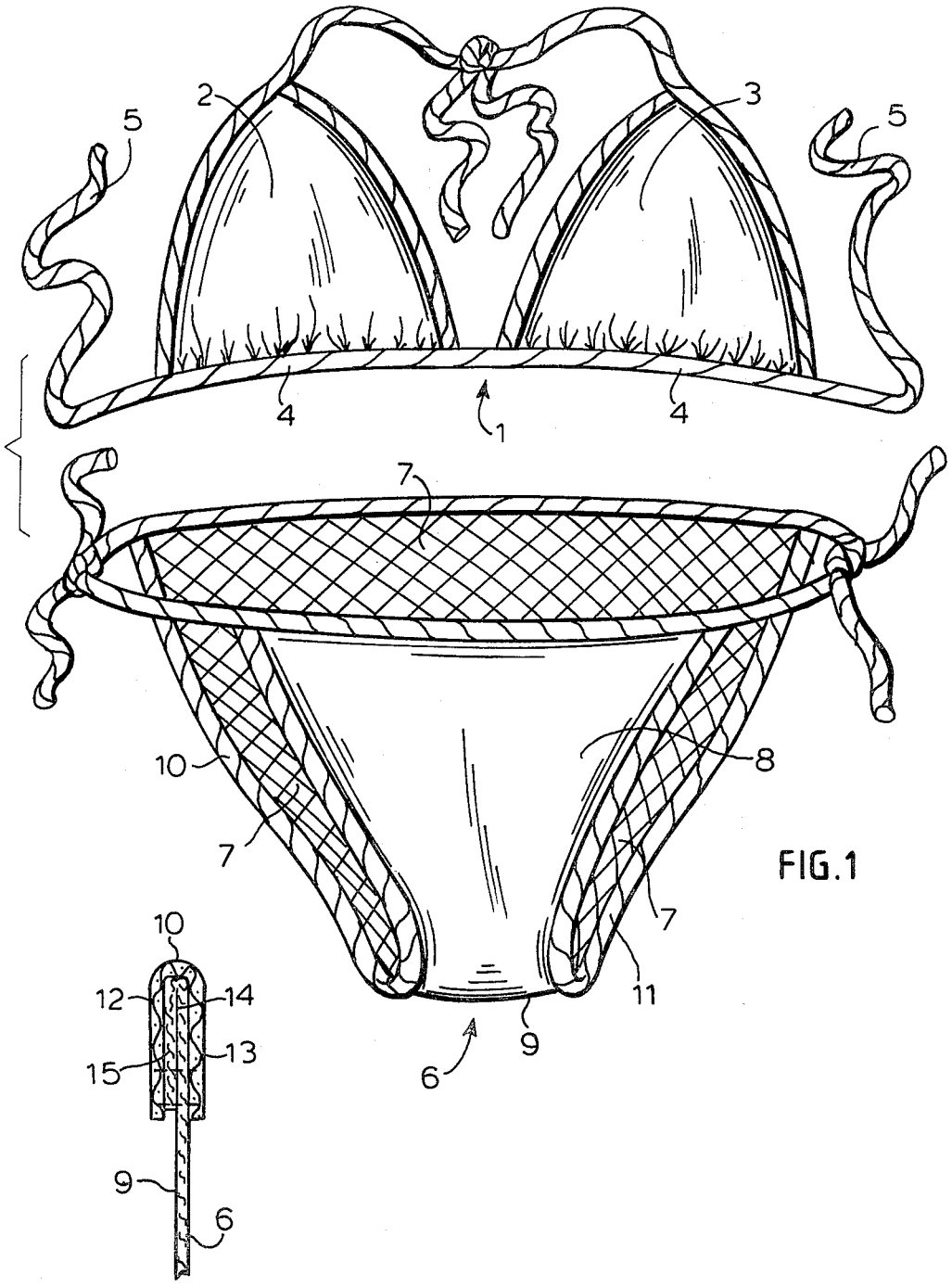
FIG. 1 shows a two piece bathing suit (pants or culotte and a brassiere) which pieces are wearable reversibly with correct adaptation for the anatomy of the wearer regardless of the side turned to the outside.
FIG. 2 is an enlarged, cross-sectional view showing an embodiment elastic tape binding on the periphery of the cloth pieces shown in FIG. 1.

The garment of the invention comprises new swim wear garments, which can be easily put together and can be used on either side. Because they are reversible, they have neither a front nor a back side. The garments of the invention may be made in any color or with different colors or with a combination of colors on one side and other colors printed on the opposite side, etc. In its manufacture, any kind of textile cloth material may be used as the cloth component, preferably those materials conventionally used in swimming apparel.

Garments of the invention include bathing wear in their most varied form, such as maillots, bikinis, etc. Preferably, the garments of the invention will be characterized in part as being made of any type of textile cloth having the characteristic of one color or combination of colors on one side of the cloth and a different color or combination of colors on the opposide side. Similarly, by using different color tones for each side, the opposite sides of the cloth body may show the same or similar or different prints. The garments of the invention may therefore offer the advantage of having two usable sides, that is, they are reversible and such reversible condition may be obtained by using a single cloth material having different colors and prints on each of its two planar surfaces.

In a preferred garment of the invention, the edges or periphery of the cloth body are finished by binding the waist and leg edges (in the case of panties and similar garments) with binding tapes having a longitudinal elasticity, i.e., they will stretch and contract along this longitudinal length or long axis. The binding tapes are preferably folded in the center along their length to form a double binding of equal width, in between which the peripheral edge of the cloth body of the garment is sewn, preferably with a zig zag or chain stitch for uniformity and wearing comfort.

In certain garments requiring a perfect adaptation of the garment to the anatomy of the body of the user (such as a bikini) the elasticity of the binding may be reinforced by incorporating between the two free edges of the folded binding tape, a fine elastic ribbon or band. Knitted or made of an elastic material, the elastic ribbon or band will be held in place around the waist by the same seam used to join the folded binding tape to the peripheral edge of the cloth body of the garment. In one embodiment, the binding tape may be of one color or printed with a design to match the different colors or prints of each of the sides of the garment cloth. This binding tape can also be made by using different colors and prints on each side of the folded tape so that it does not contrast with the color or print on the adjacent cloth body.

Further details of the garments of the invention will be observed in the following description, when read in conjunction with a viewing of the attached drawings of FIGS. 1 and 2.

FIG. 1 shows a two piece swimming garment. A brassiere 1 is made up of panels 2 and 3, each of which is made up from flat pieces of a textile cloth (single pieces), without darts or like triangle-shaped structures. On the base side 4, gathers in the panels 2, 3 are formed and secured by an elastic binding tape 5. The tape 5 extends behind the periphery of the panels 2,3 to provide ties for securing the brassiere 1 around the thorax of the wearer. The brassiere 1 is fully reversible and can be worn with either side on the outside or inside without discomfort to the wearer.

The pants 6 are also formed by a single cloth 9, which is seamless, and has a back 7 and front sides 8. The peripheral edges of the cloth 9 are bound with elastic binding tapes 10, 11. The tapes 10, 11 are conveniently extended on both sides to be tied at the end thereof and thus hold the garment on the waist of the wearer. The pants 6, like brassiere 1, are fully reversible and may be worn, without discomfort, with either side serving as the outside or the inside lines. Part of the reason for the comfortable wearing obtained is due to the structure of the binding tape 10, 11.

FIG. 2 is an enlarged cross-sectional view of a portion of the cloth 9 bounded along the periphery by tape 10 (or 11). The tapes 10 and 11 are folded along their length to form two homologous (free edges on) sides 12, 13 in between which the respective sides or borders 14 of the cloth 9 are permanently sewn, advantageously with a zig zag or chain stitch. The tapes 10, 11 may be fabricated from an elastic material, advantageously permitting their expansion and contraction in a direction parallel to their length. The elastic action of the tapes 10, 11 increases upon in corporating within their folded edges 12, 13 fine ribbon or band 15 made out of a highly elasticized material. The elastic band 15 may be a band of knitted or other elastic material which will stretch and contract lengthwise.

Because the structure of the binding tapes 10, 11 and the method of their attachment along the peripheral edge of cloths 2, 3 and 9 is highly symmetrical, each side of the pants 6 and brassiere 1 have the same overall appearance. The symmetrical structure also provides the same feeling of comfort to the wearer, regardless of which side is worn in or out. The preferred binding tape 10, 11 provide this comfort to the wearer.

The drawings described above show that it is possible to make reversible garments for swim wear, with only a single piece of material having the same or different colors or different combinations of colors on each side, in such a manner that the garment can be used with either side on the outside. In the FIG. 1, it can be seen that the outside of the pants have a solid design, which may be a print, different to the one on the inside which is a quadriculate print. Such prints can be varied with different colors or combinations of colors.

The preferred embodiments described above do not limit the invention. Any desired modifications of detail can be introduced provided that the essence of the invention described is not changed, altered, or modified. Preferably, the garment of the invention is adapted for feminine wear.

What is claimed:

1. A reversible bathing garment for wear by a human person which comprises;

a single, unseamed cloth having a first planar surface and a second planar surface, said surfaces being mutually bounded by a single, peripheral edge;

said cloth having been cut to a size and configuration whereby it will, when worn by said person, cover private parts of the person;

a binding tape secured to the entirety of the peripheral edge; and means attached to the binding tape for supporting the cloth on the body of said person.

2. The garment of claim 1 wherein the binding tape is an elastic band, permanently joined to the peripheral edges by seams and including within the folded binding a highly elastic band, said tape being folded in the center lengthwise to form two equal sides which are placed over the faces of the edge of the garment.

3. The garment of claim 2 wherein each one of the two sides of the binding tape, resulting upon folding of the binding tapes along the middle, show different designs.

* * * * *